US011844994B2

(12) United States Patent
Lozinski

(10) Patent No.: US 11,844,994 B2
(45) Date of Patent: Dec. 19, 2023

(54) STICK HANDLING TRAINING DEVICE

(71) Applicant: Micheal David Lozinski, Orangeville (CA)

(72) Inventor: Micheal David Lozinski, Orangeville (CA)

( * ) Notice: Subject to any disclaimer, the term of this patent is extended or adjusted under 35 U.S.C. 154(b) by 219 days.

(21) Appl. No.: 17/474,515

(22) Filed: Sep. 14, 2021

(65) Prior Publication Data

US 2023/0081027 A1 Mar. 16, 2023

(51) Int. Cl.

| | |
|---|---|
| ***A63B 69/36*** | (2006.01) |
| ***A63B 71/06*** | (2006.01) |
| ***A63B 71/02*** | (2006.01) |
| ***A63B 69/00*** | (2006.01) |
| ***A63B 71/00*** | (2006.01) |
| ***H05B 45/20*** | (2020.01) |
| ***H05B 47/105*** | (2020.01) |

(52) U.S. Cl.

CPC ..... *A63B 71/0622* (2013.01); *A63B 69/0024* (2013.01); *A63B 71/0054* (2013.01); *A63B 71/03* (2020.08); *H05B 45/20* (2020.01); *H05B 47/105* (2020.01); *A63B 2071/0625* (2013.01); *A63B 2071/0675* (2013.01); *A63B 2220/833* (2013.01); *A63B 2225/74* (2020.08)

(58) Field of Classification Search

CPC ..... A63B 71/0622; A63B 69/0024; A63B 71/0054; A63B 71/03; A63B 2071/0625; A63B 2071/0675; A63B 2220/833; A63B 2225/74; H05B 45/20; H05B 47/105; H05B 47/165; H05B 47/155

USPC ..... 473/422, 446

See application file for complete search history.

(56) References Cited

U.S. PATENT DOCUMENTS

| | | | | |
|---|---|---|---|---|
| 4,342,455 | A * | 8/1982 | Miyamae | A63B 69/3614 473/222 |
| 4,615,526 | A * | 10/1986 | Yasuda | A63B 69/36 273/456 |
| 4,844,469 | A * | 7/1989 | Yasuda | A63B 69/3605 473/221 |
| 5,501,452 | A | 3/1996 | Halvorson | |
| 5,826,874 | A * | 10/1998 | Teitell | A63B 69/3614 473/225 |
| 6,364,790 | B1 * | 4/2002 | Carrie | A63B 69/00 473/422 |
| 7,285,061 | B2 | 10/2007 | Wagner | |

(Continued)

FOREIGN PATENT DOCUMENTS

| | | |
|---|---|---|
| CA | 2536020 C | 8/2007 |

*Primary Examiner* — Nini F Legesse

(57) ABSTRACT

A stick handling training device is provided. A stick handling training device for practicing stick handling drills having a board surface. A plurality of lights affixed to an underside of the board surface. One or more sensors affixed to the underside of the board surface that detects a presence of one or more physical stimuli. One or more objects for stick handling having a member that generates physical stimuli and an interface display, wherein a user moves the one or more objects across the board surface. The plurality of lights turning on and off in a specific order such that only one light is on at a same time providing an appearance that a single light may be moving in a drill pattern. One or more sensors tracking at least one characteristic of the one or more objects for stick handling and the interface displaying at least one characteristic.

19 Claims, 11 Drawing Sheets

(56) References Cited

U.S. PATENT DOCUMENTS

| | | | | |
|---|---|---|---|---|
| 7,850,514 | B2 * | 12/2010 | Weber | A63B 69/0026 463/2 |
| 7,999,694 | B2 * | 8/2011 | Martin | F41J 5/24 463/2 |
| 8,182,373 | B2 * | 5/2012 | Delorme | A63B 69/0026 463/2 |
| 8,727,784 | B1 | 5/2014 | Wolf | |
| 9,636,561 | B2 | 5/2017 | Simon | |
| 9,717,968 | B2 | 8/2017 | Olsen | |
| 9,782,656 | B2 * | 10/2017 | Burke | A63B 24/0003 |
| 10,569,149 | B2 | 2/2020 | Clarke | |
| 10,722,773 | B2 * | 7/2020 | Houlihan | A63B 67/14 |
| 2008/0248902 | A1 | 10/2008 | Pittorf | |
| 2008/0287224 | A1 | 11/2008 | Salvador et al. | |
| 2020/0398134 | A1 | 12/2020 | Bartels | |

* cited by examiner

STICK HANDLING TRAINING DEVICE

FIELD OF THE INVENTION

The present disclosure relates to a stick handling training device, more specifically, but not by way of limitation, more particularly to a stick handling training device for practicing stick handling drills.

BACKGROUND

Any discussion of the related art throughout the specification should in no way be considered as an admission that such related art is widely known or forms part of common general knowledge in the field.

Stick handling is a fundamental part of hockey and a skill that hockey players of all levels and every age practice very often. It has previously been recognized that there exists a need for an apparatus or device to develop, improve and enhance a player's stick handling skills such that the player may control a ball or puck with speed and accuracy.

However, currently most stick handling training apparatus disclosed in the prior art do not provide direction and instruction with provided professional level stick handling drills and tracking mechanisms such that a user can see their performance and progress. Further, existing apparatus often lack a built-in smooth surface upon which a user could practice their stick handling.

U.S. Pub. No. 2008/0248902 A1 (Pittoft) discloses a system and method for providing a hockey stick-handling device that is capable of multiple configurations and may be expanded and collapsed without repeated assembly. Shortcomings include a lack of direction and instruction with no provided professional level stick handling drills and a lack of tracking mechanism such that a user could see their performance and progress. Further, the system and method lacks a built-in smooth surface upon which a user could practice their stick handling.

U.S. Pub. No. 2008/028722 A1 (Salvador et al.) discloses a system and method for providing a hockey stick-handling device that is capable of multiple configurations and may be expanded and collapsed without repeated assembly and includes sensors for timing and illumination. Shortcomings include a lack of direction and instruction with no provided professional level stick handling drills and while possessing real time feedback, lacks tracking of performance and progress. Further, the system and method lacks a built-in smooth surface upon which a user could practice their stick handling.

U.S. Pub. No. 2020/0398134 A1 (Bartels) discloses a hockey training apparatus to improve sports training for players and to permit-training based competitions/comparisons between players. The apparatus can be provided that include digital processors, sensor arrays and training instruction devices (e.g., light arrays) to automatically instruct the player on training sequences, track training progress and provide the ability to compete with other players. Shortcomings include a lack of direction and instruction with no provided professional level stick handling drills and lacks a built-in smooth surface upon which a user could practice their stick handling.

U.S. Pat. No. 5,501,452 A (Halvorson) discloses a putting training device and method for training a golfer's muscles to learn, recall and follow the proper putting swing. Shortcomings include a lack of direction and instruction with no provided professional level stick handling drills and a lack of tracking mechanism such that a user could see their performance and progress. Further, the training device lacks a built-in smooth surface upon which a user could practice their stick handling and only allows a user to practice one single swing motion due to the device's design for gold putting training.

U.S. Pat. No. 7,285,061 B1 (Wagner) discloses a method and apparatus for training sports skills for games including ice hockey, soccer, tennis and volleyball using one or more opponents or simulated opponents on the playing surface to train a player to strike the game object away from an opponent in addition to practicing striking the game object. For ice hockey, the controller can receive input from sensor(s) on the game object, player being trained or the goal to locate the game object and/or player to position the simulated opponent(s) to train the player to strike the game object past the simulated opponent into the goal. Shortcomings include a lack of direction and instruction with no provided professional level stick handling drills and a lack of tracking mechanism such that a user could see their performance and progress.

U.S. Pat. No. 8,182,373 B2 (Delorme) discloses a practice apparatus such as a hockey training device for enhancing a hockey player's skills in the art of stick handling. Shortcomings include a lack of multiple tracked characteristics such that a user could accurately gauge their performance and progress of their stick handling.

U.S. Pat. No. 8,727,784 B1 (Wolf) discloses a sports board training apparatus for fundamental drill practice used to improve a player's foot work, movement patterns, reactions, speed to a specific location, shot making and other repetitive athletic techniques. Shortcomings include a lack of direction and instruction with no provided professional level stick handling drills and a lack of tracking mechanism such that a user could see their performance and progress.

U.S. Pat. No. 9,636,561 B2 (Simon) discloses a hockey training device with elastic band suspended to an upper surface such that a puck may be passed towards the elastic band and the elastic band rebounds the puck towards the user. Shortcomings include a lack of direction and instruction with no provided professional level stick handling drills and a lack of tracking mechanism such that a user could see their performance and progress.

U.S. Pat. No. 9,717,968 B2 (Olsen) discloses an ice hockey practice target to be used in conjunction with an ice hockey goal on an ice surface. Shortcomings include a lack of direction and instruction with no provided professional level stick handling drills and a lack of tracking mechanism such that a user could see their performance and progress. Further, the system and method lacks a built-in smooth surface upon which a user could practice their stick handling.

U.S. Pat. No. 10,569,149 B2 (Clarke) discloses a stick handling training device for a user to hold in one hand while holding an elongate shaft of sporting equipment in another hand. Shortcomings include a lack of direction and instruction with no provided professional level stick handling drills and a lack of tracking mechanism such that a user could see their performance and progress. Further, the system and method lacks a built-in smooth surface upon which a user could practice their stick handling.

CA Pat. No. 2,536,020 C (Weber) discloses an interactive sports training device has a plurality of light sources, multiple sensor means and a processor to facilitate the maneuvering, passing and shooting of an object. Shortcomings include a lack of direction and instruction with no provided professional level stick handling drills and a lack of tracking mechanism such that a user could see their performance and progress. Further shortcomings include a lack of ability for a user to stand on the surface of the training device.

All documents cited herein are incorporated by reference.

It is clear that there exists a need for a stick handling training device for practicing stick handling drills. There is need for such a device that builds muscle memory, provides direction and instruction with professional level stick handling drills guided with lights for example, real time feedback and tracks the performance and progress of a user. Further, a need exists for such a device to have a built-in smooth surface upon which user could practice their stick handling, constructed in such a manner that the user could practice standing on the surface as well.

The disclosure proposes a stick handling training device for practicing stick handling drills that overcomes disadvantages inherent in the existing stick handling training devices, such as, but not limited to, a lack of direction and instruction with no provided professional level stick handling drills, a lack of tracking mechanisms such that a user could see their performance and progress, a lack of a built-in smooth surface upon which a user could stand and practice their stick handling. The present invention provides a stick handling training device that may be used with a puck or ball, provide direction and instruction to guide a user through professional level stick handling drills, track a user's performance and progress and include a built-in smooth surface upon which a user can stand and practice. As such, the general purpose of the present invention, which will be described subsequently in greater detail, is to provide a new and improved stick handling training device for practicing stick handling drills, which provides the advantages and overcomes the aforementioned disadvantages.

BRIEF SUMMARY

It is an object of the invention to provide stick handling training device. A stick handling training device for practicing stick handling drills having a board surface. A plurality of lights affixed to an underside of the board surface. One or more sensors affixed to the underside of the board surface that detects a presence of one or more physical stimuli. One or more objects for stick handling having a member that generates physical stimuli and an interface display, wherein a user moves the one or more objects across the board surface. The plurality of lights turning on and off in a specific order such that only one light is on at a same time providing an appearance that a single light may be moving in a drill pattern. One or more sensors tracking at least one characteristic of the one or more objects for stick handling and the interface displaying at least one characteristic.

In accordance with an embodiment of the invention, the physical stimuli is a magnetic field generated by at least one magnet.

In accordance with an embodiment of the invention, the physical stimuli is one or more of heat, light, sound, pressure, electric field or a particular motion.

In accordance with an embodiment of the invention, the one or more objects for stick handling with at least one magnet is a hockey puck.

In accordance with an embodiment of the invention, the one or more objects for stick handling with at least one magnet is a ball.

In accordance with an embodiment of the invention, the one or more objects for stick handling with at least one magnet is a hockey stick.

In accordance with an embodiment of the invention, the interface display further comprising at least one button affixed to the interface display, wherein the at least one button may allow the user to select one or more of the drill patterns, start, stop, reset the drill pattern or one or more player indicators.

In accordance with an embodiment of the invention, the interface display further comprising at least one speaker affixed to the interface display, wherein the at least one speaker provides audio feedback to the user.

In accordance with an embodiment of the invention, the interface display further comprising at least one LCD display coupled to the interface display, wherein the LCD display displays the at least one characteristic.

In accordance with an embodiment of the invention, a standalone tower houses the interface display.

In accordance with an embodiment of the invention, the drill pattern is a figure eight pattern.

In accordance with an embodiment of the invention, the drill pattern is a triangle pattern.

In accordance with an embodiment of the invention, the one or more sensors are Hall sensors.

In accordance with an embodiment of the invention, the plurality of lights are LED lights.

In accordance with an embodiment of the invention, the at least one characteristic includes one or more of time, completed reps, countdown, abort option, accuracy and high score.

In accordance with an embodiment of the invention, the one or more colors emitted from the plurality of lights is associated with an action.

In accordance with an embodiment of the invention, the interface display is coupled to an application.

In accordance with an embodiment of the invention, a non-slip foam is affixed to the underside of the board surface.

In accordance with an embodiment of the invention, the plurality of lights are affixed to the underside of the board surface via an adhesive.

In accordance with an embodiment of the invention, the one or more sensors are affixed to the underside of the board surface via an adhesive.

BRIEF DESCRIPTION OF THE SEVERAL VIEWS OF THE DRAWINGS

To easily identify the discussion of any particular element or act, the most significant digit or digits in a reference number refer to the figure number in which that element is first introduced.

DETAILED DESCRIPTION

The details of one or more embodiments of the subject matter of this specification are set forth in the accompanying drawings and the description below. Other features, aspects and advantages of the subject matter will become apparent from the description, the drawings and the claims.

Like reference numbers and designations in the various drawings indicate like elements.

Figure 1:
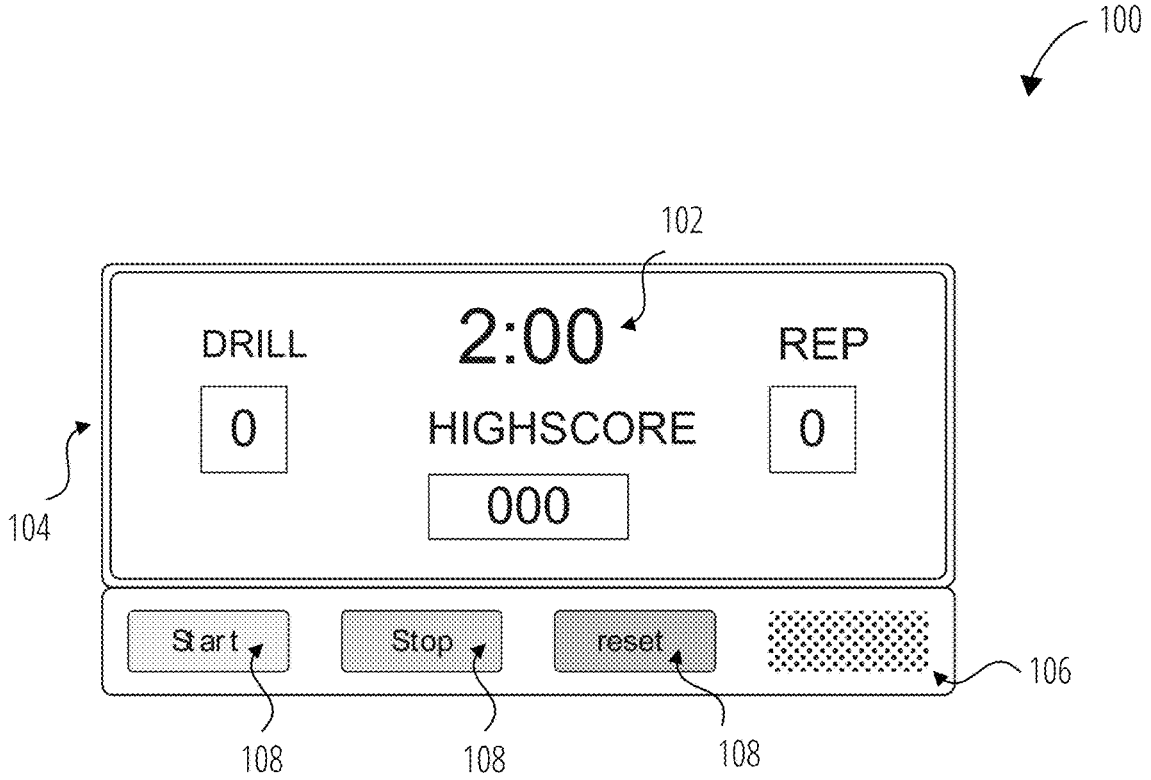
FIG. 1 illustrates an example digital display, according to some embodiments.

FIG. 1 illustrates an example of an interface display 100, according to some embodiments. The interface display 100 may, in some embodiments, be housed in a standalone tower away from the board so that a user may concentrate and practice with limited distractions.

In some embodiments, the interface display 100 may have a timer 102 and/or a scoreboard 104. The interface display 100 may count and display how many cycles the user may have completed in a set amount of time. In some embodiments, the interface display 100 may track a user's progress on different drills and may keep track of a user's best scores. In some embodiments, the interface display 100 may display power settings, allow for drill selection and/or display various different drill characteristics such as time, completed reps, countdown, abort option, accuracy, high score, among others. The interface display 100 may, in some embodiments, have a processor and memory, such as non-transitory computer-readable medium, to store information related to the aforementioned drill characteristics and display functionality.

In some embodiments, the interface display 100 may have speaker 106, which may allow for audio prompts, or a countdown, among other functions. The interface display 100 may, in some embodiments, have buttons 108 to allow a user to interface with the display, such as choose a specific drill pattern, start, stop, reset the device or one or more player indicator. The player indicator buttons may be employed to hold a top score for one or more users. In some embodiments, the reset button 108 is recessed into the interface display 100 such that accidental triggering of resetting the system is greatly reduced. For example, to activate the reset button 108, a pin may be required to access and trigger a reset of the system. In some embodiments, a speaker may provide a beep or audio queue to inform a user once they have completed an entire cycle or repetition of a chosen drill pattern. In some embodiments, the interface display 100 may have an LCD display.

In alternate embodiments, the interface display 100 may be coupled to an application, such as, but not limited to, a smartphone application or a digital web-application. The application may, in some embodiments, allow for drill scores to be published and shared among users.

Figure 2:
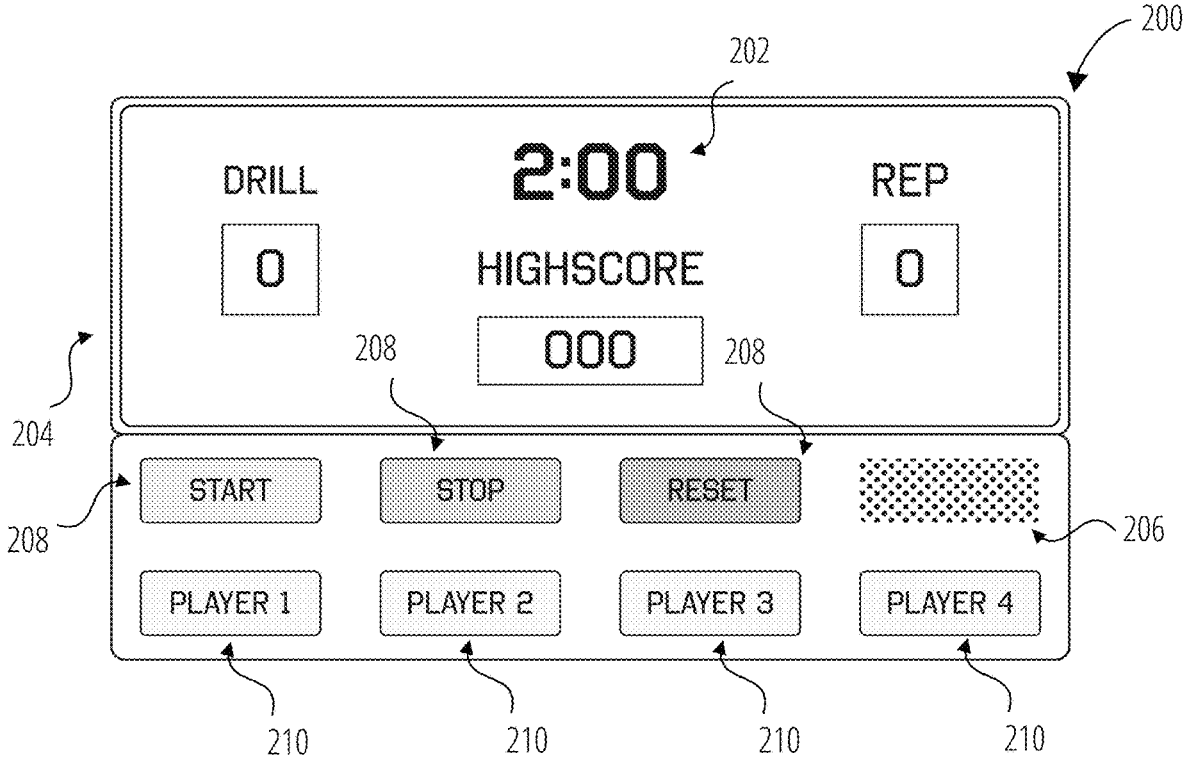
FIG. 2 illustrates an aspect of the subject matter in accordance with one embodiment.

FIG. 2 illustrates an alternative example of an interface display 200, according to some embodiments. In this example, the interface display 200 displays a timer 202, a scoreboard 204, a speaker 206, a plurality of buttons 208 to allow a user to interface with the display, such as drill pattern, start, stop, reset the device as well as a plurality of player selection buttons 210 for multiplayer use and storing a top score for each of the plurality of users. In some embodiments, the player selection button 210 lights up to indicate which player is being recorded for a selected drill.

Figure 3:
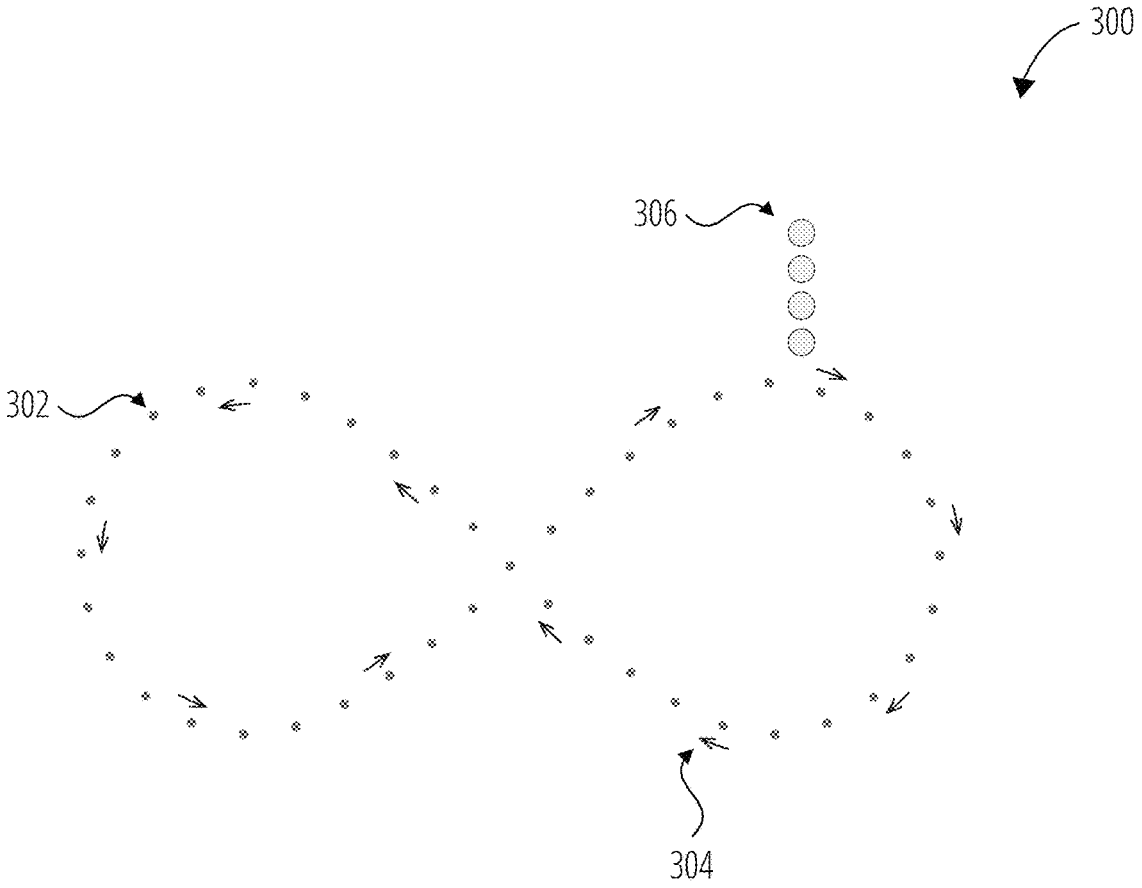
FIG. 3 illustrates an example drill pattern, according to some embodiments.

FIG. 3 illustrates an example drill pattern, according to some embodiments. Example figure eight pattern 300 may, in some embodiments, be formed by a plurality of lights 302. In some embodiments, the lights 302 may turn on and off in a specific order, such that only one light 302 may be on at a time, providing an appearance that an individual light 302 may be moving in the figure eight pattern 300, following the direction 304 shown.

In some embodiments, one or more sensors 306 may be located near one or more lights 302 and measure various characteristics of a user's stick, or puck, or ball, or the like, such as accuracy, time, number of repetitions, among others.

Figure 4:
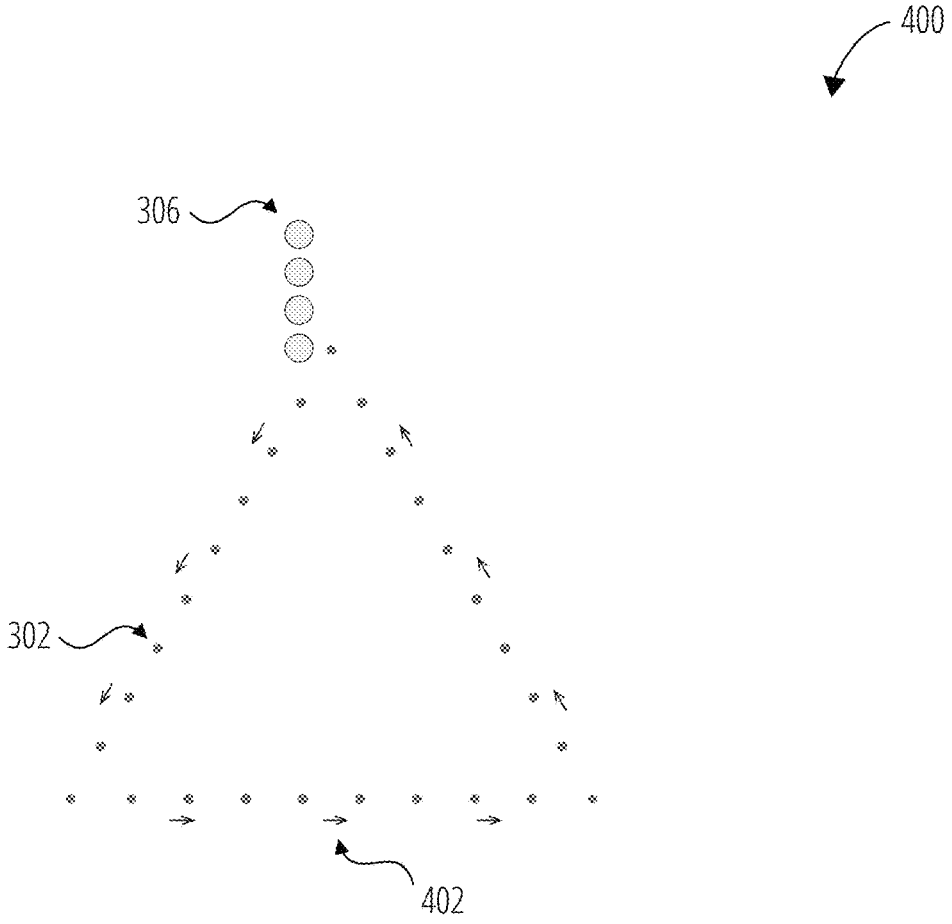
FIG. 4 illustrates an example drill pattern, according to some embodiments.

FIG. 4 illustrates an example drill pattern, according to some embodiments. Example triangle pattern 400 may, in some embodiments, be formed by a plurality of lights 302. In some embodiments, the lights 302 may turn on and off in a specific order, such that only one light 302 may be on at a time, providing an appearance that an individual light 302 may be moving in the triangle pattern 400, following the direction 402 shown.

In some embodiments, one or more sensors 306 may be located near one or more lights 302 and measure various characteristics of a user's stick, or puck, or ball, or the like, such as accuracy, time, number of repetitions, among others.

Figure 5:
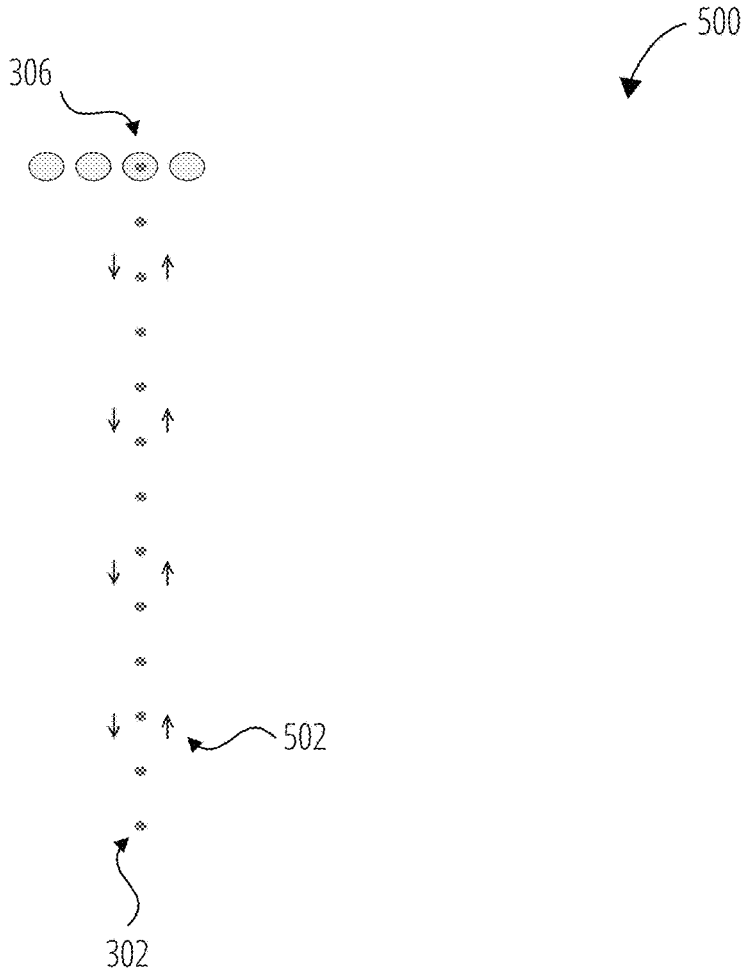
FIG. 5 illustrates an example drill pattern, according to some embodiments.

FIG. 5 illustrates an example drill pattern, according to some embodiments. Example pattern 500 may, in some embodiments, be formed by a plurality of lights 302. In some embodiments, the lights 302 may turn on and off in a specific order, such that only one light 302 may be on at a time, providing an appearance that an individual light 302 may be moving in the pattern 500, following the direction 502 shown.

In some embodiments, one or more sensors 306 may be located near one or more lights 302 and measure various characteristics of a user's stick, or puck, or ball, or the like, such as accuracy, time, number of repetitions, among others.

Figure 6:
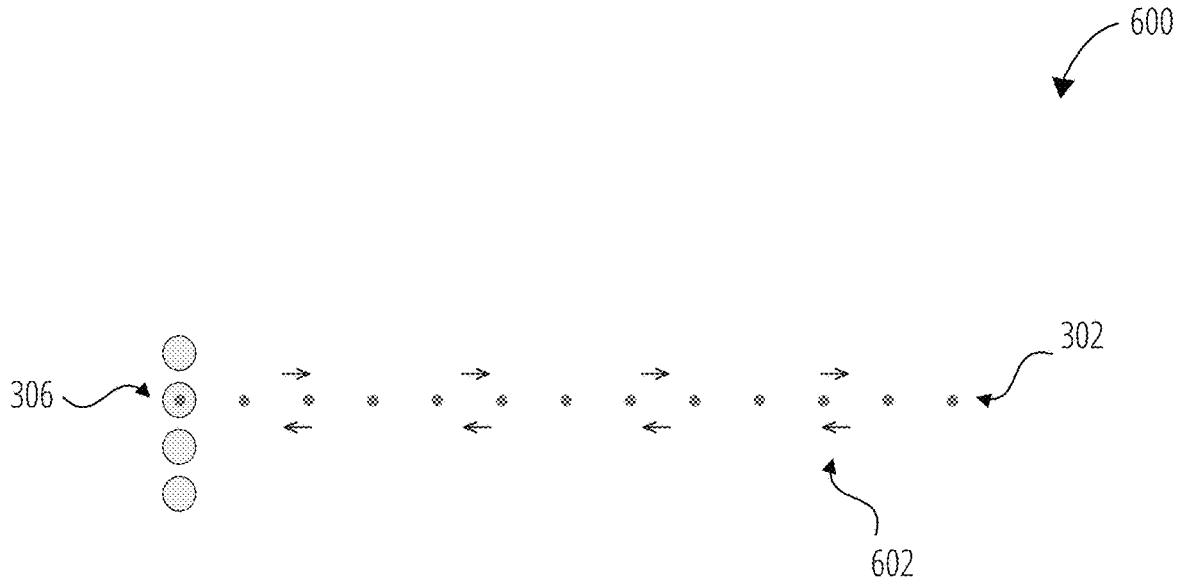
FIG. 6 illustrates an example drill pattern, according to some embodiments.

FIG. 6 illustrates an example drill pattern, according to some embodiments. Example sideways pattern 600 may, in some embodiments, be formed by a plurality of lights 302. In some embodiments, the lights 302 may turn on and off in a specific order, such that only one light 302 may be on at a time, providing an appearance that an individual light 302 may be moving in the sideways pattern 600, following the direction 602 shown.

In some embodiments, one or more sensors 306 may be located near one or more lights 302 and measure various characteristics of a user's stick, or puck, or ball, or the like, such as accuracy, time, number of repetitions, among others.

Figure 7:
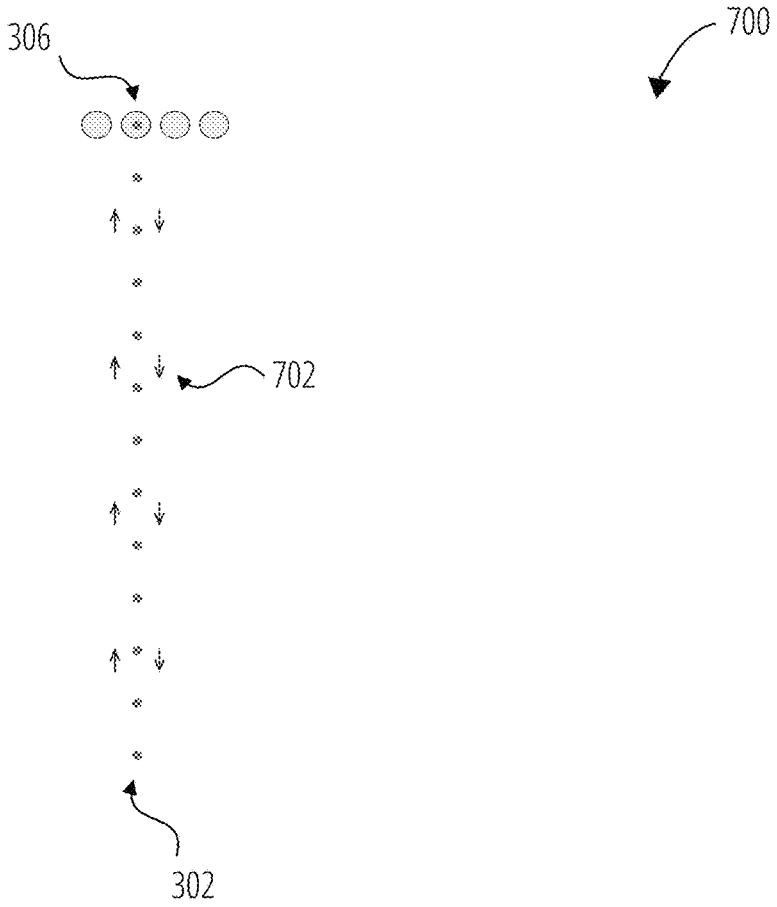
FIG. 7 illustrates an example drill pattern, according to some embodiments.

FIG. 7 illustrates an example drill pattern, according to some embodiments. Example pattern 700 may, in some embodiments, be formed by a plurality of lights 302. In some embodiments, the lights 302 may turn on and off in a specific order, such that only one light 302 may be on at a time, providing an appearance that an individual light 302 may be moving in the pattern 700, following the direction 702 shown.

In some embodiments, one or more sensors 306 may be located near one or more lights 302 and measure various characteristics of a user's stick, or puck, or ball, or the like, such as accuracy, time, number of repetitions, among others.

Figure 8:
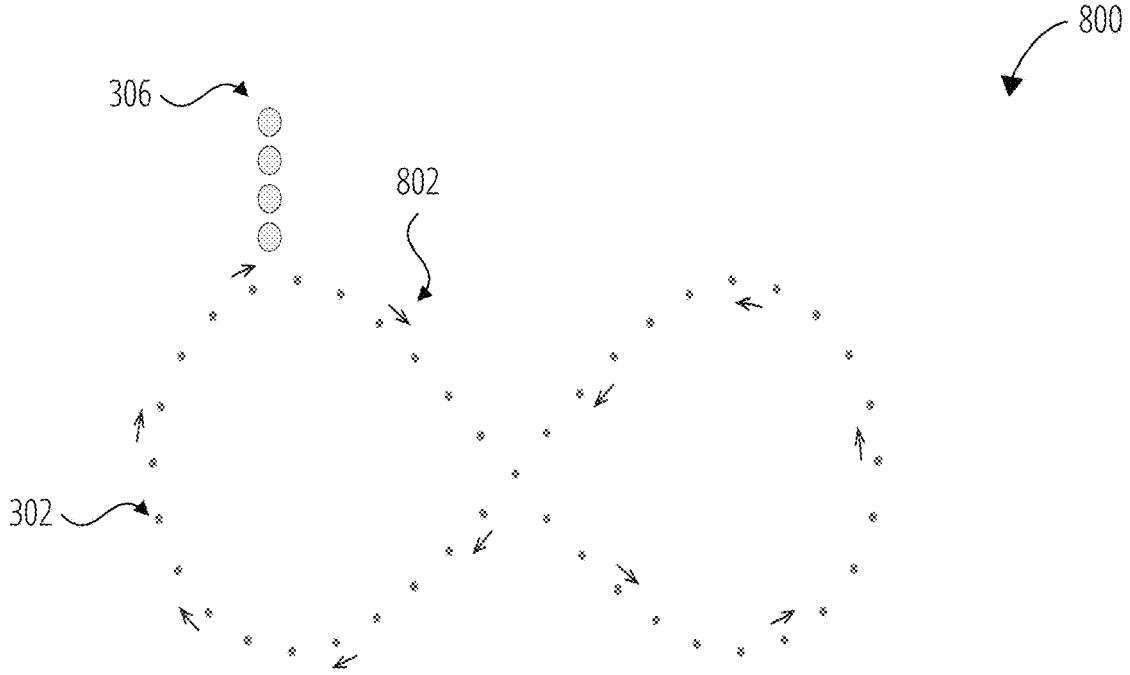
FIG. 8 illustrates an example drill pattern, according to some embodiments.

FIG. 8 illustrates an example drill pattern, according to some embodiments. Example figure eight pattern 800 may, in some embodiments, be formed by a plurality of lights 302. In some embodiments, the lights 302 may turn on and off in a specific order, such that only one light 302 may be on at a time, providing an appearance that an individual light 302 may be moving in the figure eight pattern 800, following the direction 802 shown.

In some embodiments, one or more sensors 306 may be located near one or more lights 302 and measure various characteristics of a user's stick, or puck, or ball, or the like, such as accuracy, time, number of repetitions, among others.

Figure 9:
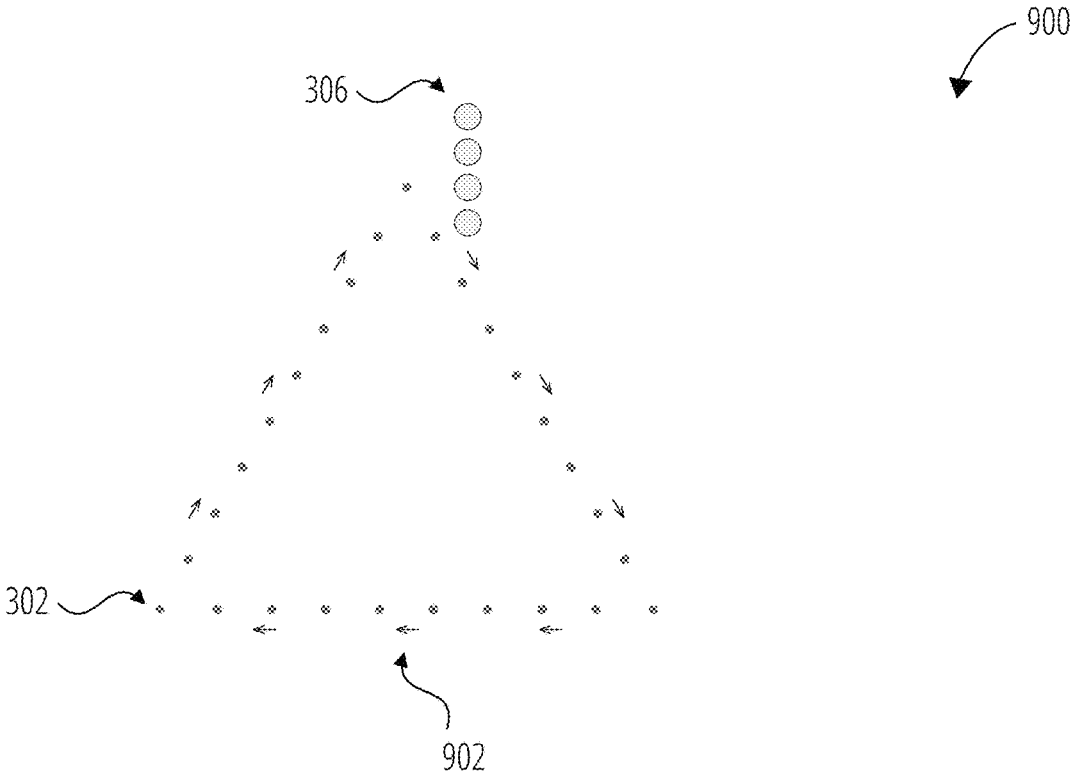
FIG. 9 illustrates an illustrates an example drill pattern, according to some embodiments.

FIG. 9 illustrates an example drill pattern, according to some embodiments. Example triangle pattern 900 may, in some embodiments, be formed by a plurality of lights 302. In some embodiments, the lights 302 may turn on and off in a specific order, such that only one light 302 may be on at a time, providing an appearance that an individual light 302 may be moving in the triangle pattern 900, following the direction 902 shown.

In some embodiments, one or more sensors 306 may be near one or more lights 302 and measure various characteristics of a user's stick, or puck, or ball, or the like, such as accuracy, time, number of repetitions, among others.

Figure 10:
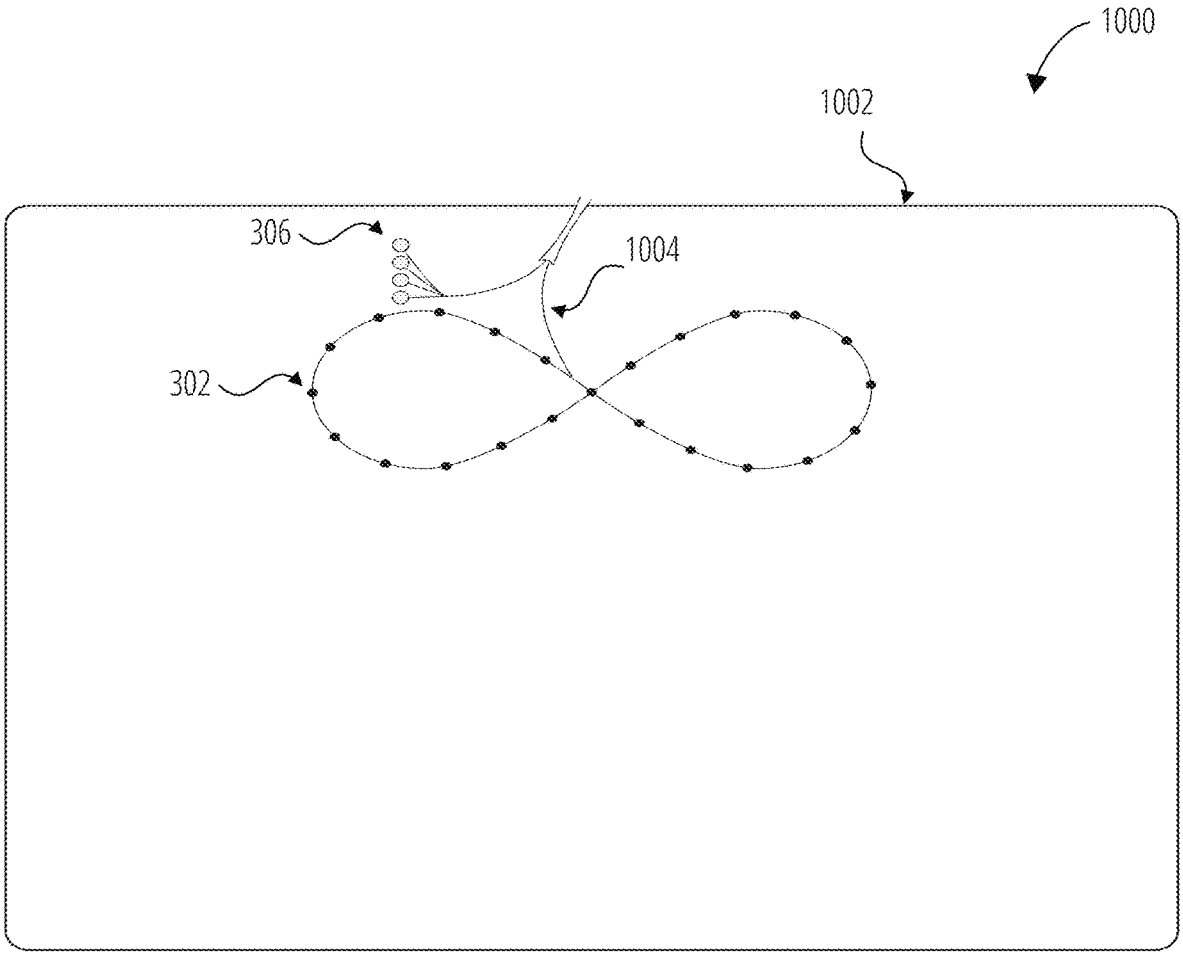
FIG. 10 illustrates an example stick handling device, according to some embodiments.

FIG. 10 illustrates an example stick handling training device 1000, according to some embodiments. The stick handling training device 1000 may, in some embodiments, have a surface board 1002. In some embodiments, a plurality of lights 302 and one or more sensors 306 may be affixed to an underside of the surface board 1002 via an adhesive. In some embodiments, wires 1004 may be connected to lights 302 and/or sensors 306. The wires 1004 may provide power and/or communication with a digital display, among other functions. The one or more sensors 306 are employed to detect a presence of one or more physical stimuli, such as but not limited to, heat, light, sound, pressure, magnetic field, electric field, or a particular motion.

The surface board 1002 may, in some embodiments, be made of PVC or plexiglass with a built-in display on the surface. Shown on the stick handling training device 1000 may be a similar drill to that shown in figure eight pattern 300 or figure eight pattern 800. In some embodiments, a stick handling drill, such as the figure eight patterns 300, may be displayed on the surface board 1002 through the illuminated lights 302. The stick handling drills may, in some embodiments, be preprogrammed into the stick handling training device 1000 and may be customizable in various ways, such as, but not limited to, time, speed and drill pattern. For example, in some embodiments the displayed drill pattern may be designated based on age group.

In some embodiments, the sensors 306 are Hall sensors. In some embodiments, the lights 302 are LED lights.

In some embodiments, the surface board 1002 may have specific colors emitted from the lights 302 associated to certain actions, such as a red light to indicate power, a blue light flashing as a countdown to commence a drill, among others. In some embodiments, the stick handling training device 1000 may allow for a user to stand on top of the surface board 1002. The sensors 306 may count how many cycles a user has done in a set time and the stick handling training device 1000 may teach a user to do appropriate drills for stick handling, similar to drills done by professional hockey players, guiding users through the drills using the lights 302

Figure 11:
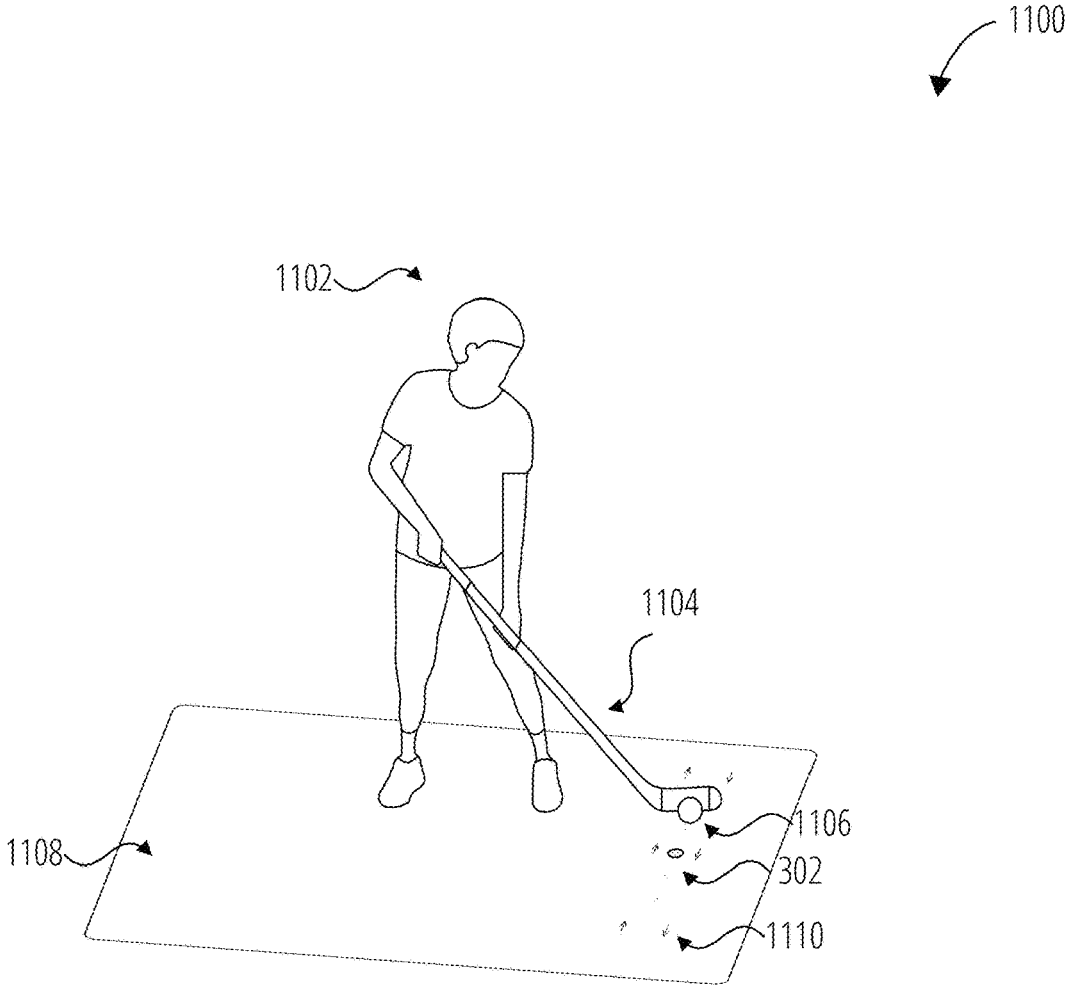
FIG. 11 illustrates an example stick handling device being used, according to some embodiments.

FIG. 11 illustrates an example embodiment 1100 of a stick handling training device 1000 being used, according to some embodiments. The user 1102 may use the stick 1104 to practice their stick handling with a ball 1106, on the surface board 1108. In some embodiments, the ball 1106 may be a puck, or the like.

In some embodiments, the stick 1104 and/or ball 1106 may be equipped with a device that generates one or more physical stimuli, for instance a magnet having a magnetic field, which may be tracked as it moves along the surface board 1108 and may be tracked by sensors 306 affixed to the surface board 1108. In some embodiments, the one or more physical stimuli include, but are not limited to, heat, light, sound, pressure, electric field, or a particular motion. In some embodiments, the ball 1106 may have a magnet inserted within the ball 1106 during construction. In some embodiments, the stick 1104 may have a magnet inserted within the blade of the stick 1104 during construction. In some embodiments, the ball 1106 may have a magnet sleeve optionally inserted over the ball 1106 during use of the stick handling training device 1000. In some embodiments, the stick 1104 may have a magnet sleeve optionally inserted over the blade of the stick 1104 during use of the stick handling training device 1000.

The shown stick handling training device 1000, similar to stick handling training device 1000 may promote stick-handling while building muscle memory for the user 1102. The surface board 1108 may run the user 1102 through stick handling drills, while assisting the user 1102 with the lights 302 which show the user 1102 proper ways to stick handle the ball 1106. For example, the lights 302 may turn on and off in a specific order, such that only one light 302 may be on at a time, providing an appearance that an individual light 302 may be moving in a preprogrammed drill pattern, following the direction 1110.

In some embodiments, the sensors 306 may be near the lights 302 and measure various characteristics of a user's stick 1104, or puck, or ball 1106, or the like, such as accuracy, time, number of repetitions, among others. An application is coupled to the sensors 306 to receive the measured characteristics for recording, analyzing and publishing stick handling data. In some embodiments, the surface board 1108 may be made of frosted white acrylic. In some embodiments, there may be a non-slip foam on the underside of the surface board 1108. In some embodiments, the user 1102 may stand on the surface board 1108, as shown in example embodiment 1100.

Stick handling is a fundamental part of hockey and example embodiment 1100 of a stick handling training device 1000 may support players and user's practicing stick handling drills. These drills may be practiced by players of all ages and any skill level. When a user 1102 first starts using the stick handling training device 1000, they may be staring at the surface board 1108 to follow the lights 302. With continued practice, the user 1102 may build their muscle memory and may be able to complete the drills with their head up, because there may be less of a need for the user 1102 to look directly at the ball 1106.

In some embodiments, the purpose of example embodiment 1100 is to create hockey muscle memory such that a user 1102 can skate and move the puck with their head up after practicing drills. This may be facilitated by a user 1102 practicing on example embodiment 1100 and playing through the many different stick handling drills. These drills may work both the user's strong and weak side and may help them improve their game, in some embodiments.

In some embodiments, a user 1102 may have a directed goal to complete the circuit as many times possible within the 2:00 minute time frame and the score may be recorded for a user 1102 to view and attempt to improve upon in future attempts.

In some embodiments, example embodiment 1100 may contain a separate, standalone tower containing a display, such as interface display 100. A separate tower may allow user 1102 to practice their stick handling without added distractions from a display or screen nearby. Lights 302 may be set to different speeds, such as a low speed, such that the user 1102 is able to see a drill pattern and follow along. It may be important for the user 1102 to begin at a slower speed and master the chosen pattern before increasing the speed. Example embodiment 1100 may contain sensors, which may be designed to count the completed repetitions, among other characteristics.

Example embodiment 1100 may in some embodiments, contain a magnet bladed cover for stick 1104, so that the user 1102 may practice using any puck, ball, or the like. This may also allow the user 1102 to practice with only a stick 1104, while still being able to track their progress.

The foregoing descriptions of specific embodiments of the present invention have been presented for purposes of illustration and description. They are not intended to be exhaustive or to limit the invention and method of use to the precise forms disclosed. Obviously, many modifications and variations are possible in light of the above teaching. As can be understood, the examples described above are intended to be exemplary only.

The embodiments described were chosen and described in order to best explain the principles of the invention and its practical application and to thereby enable others skilled in the art to best utilize the invention and various embodiments with various modifications as are suited to the particular use contemplated. It is understood that various omissions or substitutions of equivalents are contemplated as circumstance may suggest or render expedient but is intended to cover the application or implementation without departing from the spirit or scope of the claims of the present invention.

The term "connected", "attached", "affixed" or "coupled to" may include both direct coupling (in which two elements that are coupled to each other contact each other) and indirect coupling (in which at least one additional element is located between the two elements).

As one of ordinary skill in the art will readily appreciate from the disclosure, processes, machines, manufacture, compositions of matter, means, methods, or steps, presently existing or later to be developed, that perform substantially the same function or achieve substantially the same result as the corresponding embodiments described herein may be utilized. Accordingly, the appended claims are intended to include within their scope such processes, machines, manufacture, compositions of matter, means, methods, or steps.

What is claimed is:

1. A stick handling training device for practicing stick handling drills, comprising:

a board surface;

a plurality of lights affixed to an underside of said board surface;

one or more sensors being affixed to said underside of said board surface that detects a presence of one or more physical stimuli;

one or more objects for stick handling having a member that generates said physical stimuli;

an interface display;

wherein a user moves said one or more objects across said board surface, said plurality of lights turning on and off in a specific order such that only one light is on at a same time providing an appearance that a single light may be moving in a drill pattern, said one or more sensors tracking at least one characteristic of said one or more objects for stick handling following the drill pattern, independently of said plurality of lights turning on and off, and said interface displaying said at least one characteristic.

2. The stick handling training device of claim 1, wherein said physical stimuli is a magnetic field generated by at least one magnet.

3. The stick handling training device of claim 1, wherein said physical stimuli is one or more of heat, light, sound, pressure, electric field or a particular motion.

4. The stick handling training device of claim 1, wherein said one or more objects for stick handling with at least one magnet is one of: a hockey puck, a ball, a hockey stick, a hockey stick blade covering, and a hockey stick covering.

5. The stick handling training device of claim 1, wherein said interface display further comprising:

at least one button affixed to said interface display;

wherein said at least one button may allow said user to select one or more of said drill patterns, start, stop, reset said drill pattern or one or more player indicators.

6. The stick handling training device of claim 1, wherein said interface display further comprising:

at least one speaker affixed to said interface display;

wherein said at least one speaker provides audio feedback to said user.

7. The stick handling training device of claim 1, wherein said interface display further comprising:

at least one LCD display coupled to said interface display;

wherein said LCD display displays said at least one characteristic.

8. The stick handling training device of claim 1, wherein a standalone tower houses said interface display.

9. The stick handling training device of claim 1, wherein said drill pattern is a one of: figure eight pattern, a triangle pattern, a horizontal linear pattern and a vertical linear pattern.

10. The stick handling training device of claim 1, wherein said one or more sensors are Hall sensors.

11. The stick handling training device of claim 1, wherein said plurality of lights are LED lights.

12. The stick handling training device of claim 1, wherein said at least one characteristic includes one or more of time, completed reps, countdown, abort option, accuracy and high score.

13. The stick handling training device of claim 1, wherein one or more colors emitted from said plurality of lights is associated with an action.

14. The stick handling training device of claim 1, where said interface display is coupled to an application.

15. The stick handling training device of claim 1, wherein a non-slip foam is affixed to said underside of said board surface.

16. The stick handling training device of claim 1, wherein said plurality of lights are affixed to said underside of said board surface via an adhesive.

17. The stick handling training device of claim 1, wherein said one or more sensors are affixed to said underside of said board surface via an adhesive.

18. A method of practicing stick handing drills, comprising:

displaying a drill pattern on a stick handling training device, the stick handling training device comprising:

a board surface;

a plurality of lights affixed to an underside of said board surface;

one or more sensors being affixed to said underside of said board surface that detects a presence of one or more physical stimuli;

one or more objects for stick handling having a member that generates said physical stimuli;

an interface display;

tracking at least one characteristic of said one or more objects for stickhandling with said one or more sensors, said tracking occurring independently of said displaying of said drill pattern; and displaying the at least one characteristic on said interface display, wherein said drill pattern is displayed via said plurality of lights turning on and off in a specific order such that only one light is one at a same time providing an appearance that a single light may be moving in a drill pattern.

19. The method of claim 18, wherein said drill pattern is a one of: figure eight pattern, a triangle pattern, a horizontal linear pattern and a vertical linear pattern.

* * * * *